US007785070B2

(12) United States Patent
Liang

(10) Patent No.: US 7,785,070 B2
(45) Date of Patent: Aug. 31, 2010

(54) WAVY FLOW COOLING CONCEPT FOR TURBINE AIRFOILS

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 752 days.

(21) Appl. No.: 11/728,884

(22) Filed: Mar. 27, 2007

(65) Prior Publication Data

US 2009/0068022 A1 Mar. 12, 2009

(51) Int. Cl.
*F01D 25/12* (2006.01)

(52) U.S. Cl. ..... 416/97 R

(58) Field of Classification Search ..... 416/92, 416/96 R, 97 R; 415/115
See application file for complete search history.

(56) References Cited

U.S. PATENT DOCUMENTS 5,232,343 A 8/1993 Butts
5,645,397 A 7/1997 Soechting et al.
5,752,801 A 5/1998 Kennedy
5,967,752 A * 10/1999 Lee et al. ..... 416/97 R
5,971,708 A * 10/1999 Lee ..... 416/97 R
6,099,252 A 8/2000 Manning et al.
6,220,817 B1 * 4/2001 Durgin et al. ..... 416/97 R
6,379,118 B2 4/2002 Lutum et al.
6,994,524 B2 2/2006 Owen et al.
7,021,893 B2 4/2006 Mongillo, Jr. et al.
7,293,962 B2 * 11/2007 Fried et al. ..... 416/97 R
2003/0108422 A1 6/2003 Merry

OTHER PUBLICATIONS

Prager, Jesse M.; Office Action Final Rejection in U.S. Appl. No. 11/728,887; Apr. 23, 2010; U.S. Patent and Trademark Office; Alexandria, VA.

* cited by examiner

*Primary Examiner*—Ninh H Nguyen

(57) ABSTRACT

An airfoil including an outer wall and a cooling cavity formed therein. The cooling cavity includes a leading edge flow channel located adjacent a leading edge of the airfoil and a trailing edge flow channel located adjacent a trailing edge of the airfoil. Each of the leading edge and trailing edge flow channels define respective first and second flow axes located between pressure and suction sides of the airfoil. A plurality of rib members are located within each of the flow channels, spaced along the flow axes, and alternately extending from opposing sides of the flow channels to define undulating flow paths through the flow channels.

20 Claims, 4 Drawing Sheets

WAVY FLOW COOLING CONCEPT FOR TURBINE AIRFOILS

This invention was made with U.S. Government support under Contract Number DE-FC26-05NT42644 awarded by the U.S. Department of Energy. The U.S. Government has certain rights to this invention.

FIELD OF THE INVENTION

This invention is directed generally to an airfoil for a gas turbine engine and, more particularly, to a turbine blade airfoil having cooling cavities for conducting a cooling fluid to cool a leading edge and a trailing edge of the blade.

BACKGROUND OF THE INVENTION

A conventional gas turbine engine includes a compressor, a combustor and a turbine. The compressor compresses ambient air which is supplied to the combustor where the compressed air is combined with a fuel and ignites the mixture, creating combustion products defining a working gas. The working gas is supplied to the turbine where the gas passes through a plurality of paired rows of stationary vanes and rotating blades. The rotating blades are coupled to a shaft and disc assembly. As the working gas expands through the turbine, the working gas causes the blades, and therefore the shaft and disc assembly, to rotate.

Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades comprise a root, a platform and an airfoil that extends outwardly from the platform. The airfoil is ordinarily composed of a tip, a leading edge and a trailing edge. Most blades typically contain internal cooling channels forming a cooling system. The cooling channels in the blades may receive air from the compressor of the turbine engine and pass the air through the blade. The cooling channels often include multiple flow paths that are designed to maintain the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

A conventional cooling system in a turbine blade assembly may include an intricate maze of cooling flow paths through various portions of the turbine blade. While many of the known cooling systems for turbine blades have operated successfully, a need still exists to provide increased cooling capability, particularly in the leading edge and the trailing edge portions of turbine blades.

SUMMARY OF THE INVENTION

In accordance with one aspect of the invention, an airfoil for a turbine of a gas turbine engine is provided. The airfoil comprises an outer wall extending radially between opposing inner and outer ends of the airfoil, and the outer wall comprises a pressure side and a suction side joined together at chordally spaced apart leading and trailing edges of the airfoil. A radially extending cooling cavity is located between the inner and outer ends of the airfoil and between the pressure side and the suction side. At least one partition extends radially through the cooling cavity and extends from the pressure side to the suction side. The at least one partition defines at least one flow channel within the cooling cavity adjacent at least one of the leading edge and the trailing edge. The at least one flow channel defines a flow axis extending between the pressure side and the suction side from a fluid entrance to a fluid exit at an opposite end of the at least one flow channel. A plurality of rib members extend transversely to the flow axis into the at least one flow channel. The rib members are spaced from each other along the flow axis and extend alternately from opposing sides of the at least one flow channel to direct flow of cooling fluid in an undulating path alternately impinging on the opposing sides of the at least one flow channel.

In accordance with another aspect of the invention, an airfoil for a turbine blade of a gas turbine engine is provided. The airfoil comprises an outer wall extending radially between opposing inner and outer ends of the airfoil, the outer wall comprises a pressure side and a suction side joined together at chordally spaced apart leading and trailing edges of the airfoil. A radially extending cooling cavity is located between the inner and outer ends of the airfoil and between the pressure side and the suction side. A first partition extends radially through the cooling cavity adjacent the leading edge and extends from the pressure side to the suction side to define a leading edge flow channel. The leading edge flow channel defines a first flow axis extending between the pressure side and the suction side from a fluid entrance to a fluid exit at an opposite end of the leading edge flow channel. A plurality of first rib members extend transversely to the first flow axis into the leading edge flow channel. The rib first members are spaced from each other along the first flow axis and extend alternately from opposing sides of the leading edge flow channel to direct flow of cooling fluid in an undulating path alternately impinging on the opposing sides of the leading edge flow channel. A second partition extends radially through the cooling cavity adjacent the trailing edge and extends from the pressure side to the suction side to define at least one trailing edge flow channel. The at least one trailing edge flow channel defines at lease one second flow axis extending between the pressure side and the suction side from a fluid entrance to a fluid exit at an opposite end of the at least one trailing edge flow channel. A plurality of second rib members extend transversely to the at least one second flow axis into the at least one trailing edge flow channel. The second rib members are spaced from each other along the at least one second flow axis and extend alternately from opposing sides of the at least one trailing edge flow channel to direct flow of cooling fluid in an undulating path alternately impinging on the opposing sides of the at least one trailing edge flow channel.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
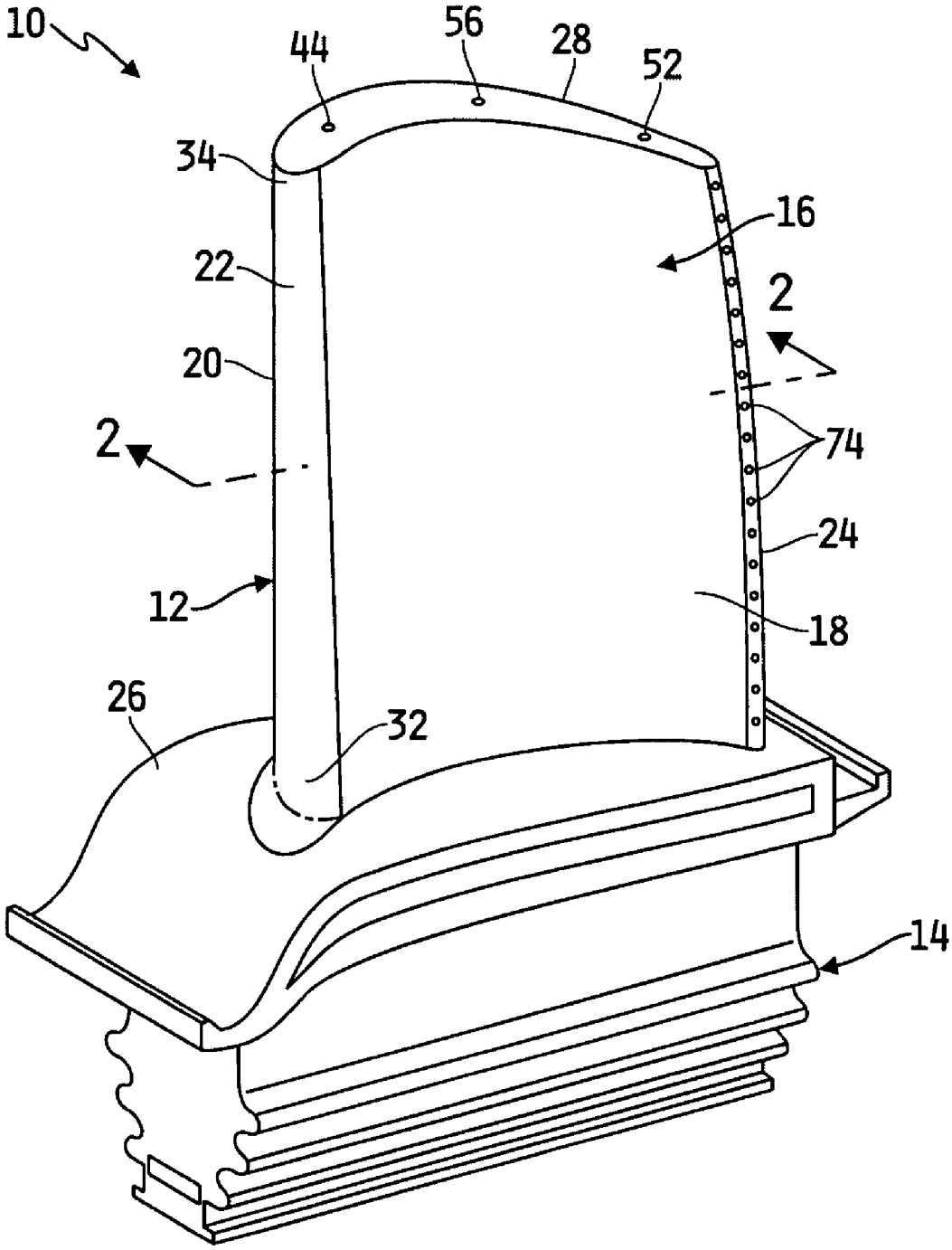
FIG. 1 is a perspective view of a turbine blade incorporating the present invention.

Referring now to FIG. 1, a turbine blade 10 constructed in accordance with the present invention is illustrated. The blade 10 is adapted to be used in a gas turbine (not shown) of a gas turbine engine (not shown). The gas turbine engine includes a compressor (not shown), a combustor (not shown), and a turbine (not shown). The compressor compresses ambient air. The combustor combines compressed air with a fuel and ignites the mixture creating combustion products defining a high temperature working gas. The high temperature working gas travels to the turbine. Within the turbine are a series of rows of stationary vanes and rotating blades. Each pair of rows of vanes and blades is called a stage. Typically, there are four stages in a turbine.

The stationary vanes and rotating blades are exposed to the high temperature working gas. To cool the vanes and blades, cooling air from the compressor is provided to the vanes and the blades.

The blade 10 includes an airfoil 12 and a root 14 which is used to conventionally secure the blade 10 to a rotor disc of the engine for supporting the blade 10 in the working medium flow path of the turbine where working medium gases exert motive forces on the surfaces thereof. The airfoil 12 has an outer wall 16 comprising a generally concave pressure side 18 and a generally convex suction side 20. The pressure and suction sides 18, 20 are joined together along an upstream leading edge 22 and a downstream trailing edge 24. The leading and trailing edges 22, 24 are spaced axially or chordally from each other. The airfoil 12 extends radially along a longitudinal or radial direction of the blade 10, defined by a span of the airfoil 12, from a radially inner airfoil platform 26 to a radially outer blade tip surface 28.

Figure 2:
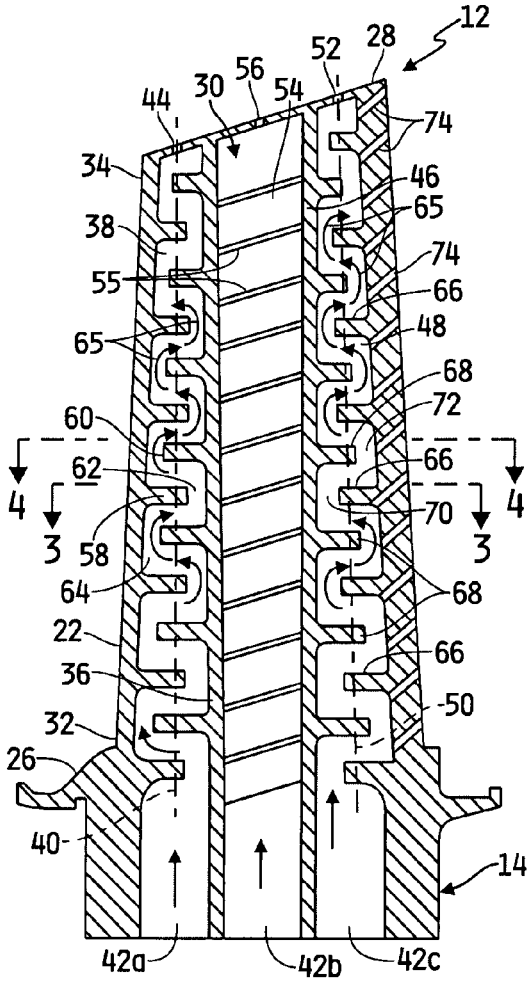
FIG. 2 is a cross-sectional view of the turbine blade shown in FIG. 1 taken along line 2-2.

Referring to FIG. 2, the airfoil 12 defines a radially extending cooling cavity 30 located between the pressure side 18 and the suction side 20 and extending between inner and outer ends 32, 34 of the airfoil 12 at the root 14 and tip 28, respectively, of the blade 10. A first partition 36 extends radially through the cooling cavity 30 adjacent to the leading edge 22. The first partition 36 extends between the pressure and suction sides 18, 20 to define a leading edge flow channel 38. The leading edge flow channel 38 defines a first flow axis 40 located generally centrally between the pressure and suction sides 18, 20 and between the leading edge 22 and the first partition 36. Cooling fluid entering from a leading edge fluid entrance 42*a* within the root 14 flows generally along the first flow axis 40 to a leading edge fluid exit defined by an opening 44 at the blade tip 28.

A second partition 46 extends radially through the cooling cavity 30 between the pressure and suction sides 18, 20 and adjacent to the trailing edge 24 to define a trailing edge flow channel 48. The trailing edge flow channel 48 defines a second flow axis 50 located generally centrally between the pressure and suction sides 18, and between the trailing edge 24 and the partition 46. Cooling fluid entering from a trailing edge fluid entrance 42*c* within the root 14 flows generally along the second flow axis 50 to a leading edge fluid exit defined by an opening 52 at the blade tip 28.

A mid-chord flow channel 54 is located within the cooling cavity 30 between the first partition 36 and the second partition 46. Cooling fluid enters the mid-chord flow channel 54 through a fluid entrance 42*b* in the root 14 and exits through a fluid exit defined by an opening 56 at the blade tip 28. The mid-chord flow channel 54 may further be provided with trip strips 55 along the interior surfaces of the pressure and suction sides 18, 20 to increase turbulence of the flow of cooling fluid along the interior surfaces, and thereby improve heat transfer at the boundary layer between the cooling fluid flow and the interior surfaces.

Figure 3:
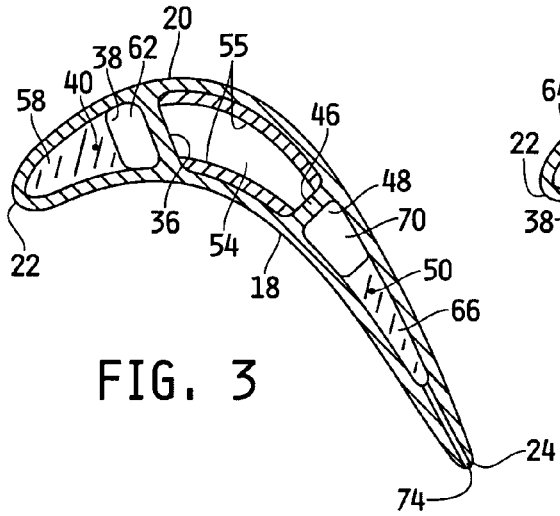
FIG. 3 is cross-sectional view of the turbine blade shown in FIG. 2 taken along line 3-3.
Figure 4:
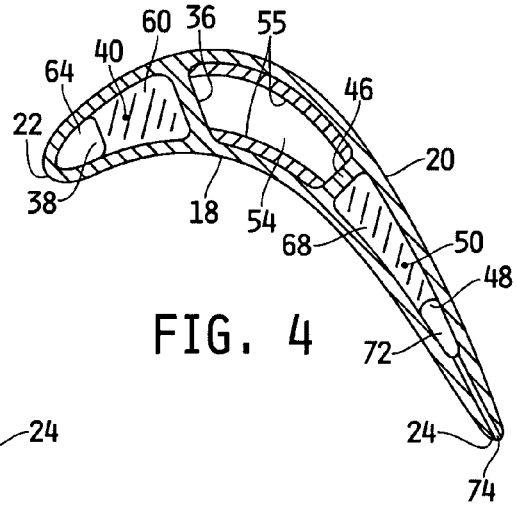
FIG. 4 is a cross-sectional view of the turbine blade shown in FIG. 2 taken along line 4-4.

As seen in FIGS. 2-4, a plurality of first rib members 58, 60 extend transversely to the first flow axis 40. The first rib members 58, 60 are spaced from each other in the radial direction, along the first flow axis 40, and extend in the chordal direction alternately from opposing sides of the leading edge flow channel 38. Specifically, the first partition 36 forms a side from which the rib members 60 extend, and the leading edge 22 forms an opposing side from which the rib members 58 extend. The first rib members 58, 60 each include a distal end that substantially extends past the first flow axis 40, and flow passages 62, 64 are defined adjacent the distal ends of the first rib members 58, 60, respectively, to permit passage of cooling fluid. Accordingly, the cooling fluid passing through the leading edge flow channel 38 cannot flow in a straight path as it flows along the first flow axis 40.

Similarly, the trailing edge flow channel 48 comprises a plurality of second rib members 66, 68 extending transversely to the second flow axis 50. The second rib members 66, 68 are spaced from each other in the radial direction, along the second flow axis 50, and extend in the chordal direction alternately from opposing sides of the trailing edge flow channel 48. Specifically, the second partition 46 forms a side from which the rib members 68 extend, and the trailing edge 24 forms an opposing side from which the rib members 66 extend. The second rib members 66, 68 each include a distal end that substantially extends past the second flow axis 50, and flow passages 70, 72 are defined adjacent the distal ends of the second rib members 66, 68, respectively, to permit passage of cooling fluid. Accordingly, the cooling fluid passing through the trailing edge flow channel 48 cannot flow in a straight path as it flows along the second flow axis 50.

In addition, a plurality of trailing edge cooling holes 74 are provided extending from the trailing edge flow channel 48 through the trailing edge 24. Cooling fluid passing through the trailing edge flow channel 48 may pass through the cooling holes 74 to provide a cooling film to the exterior surface of the trailing edge 24.

The cooling fluid passing through both the leading edge flow channel 38 and the trailing edge flow channel 48 follows a wavy or undulating flow path as it flows from the inner end 32 to the outer end 34 of the airfoil 12. The undulating flow paths are defined by essentially semi-circular flow sections 65 (see FIG. 2), formed about the flow axes 40, 50, as the fluid flows alternately around the first rib members 58, 60 for the leading edge flow channel 38 and around the second rib members 66, 68 for the trailing edge flow channel 48. The undulating flow paths create an impinging flow against the leading edge 22 and trailing edge 24 of the airfoil 12 to create a high internal heat transfer coefficient, which is further facilitated by the converging walls of the pressure and suction sides 18, 20 at the leading edge 22 and trailing edge 24. In addition to the improved heat transfer from the impingement flow created by the undulating flow paths, the direction changes associated the undulating paths as the cooling fluid is caused to turn around the rib members 58, 60 and 66, 68 causes a decrease in pressure with an associated increase in momentum. The increase in momentum operates to further increase the heat transfer coefficient along the flow channels 38, 48.

It should be noted that there is centrifugal pumping effect associated with the rotating blade 10, where the pressure of the cooling fluid increases with increasing radius or distance from the inner end 32. Accordingly, although there is a pressure decrease resulting from the cooling fluid changing direction as it turns around the rib members 58, 60 and 66, 68, the centrifugal pumping effect operates to offset the turn loss and friction loss as the cooling fluid follows the undulating paths.

Figure 5:
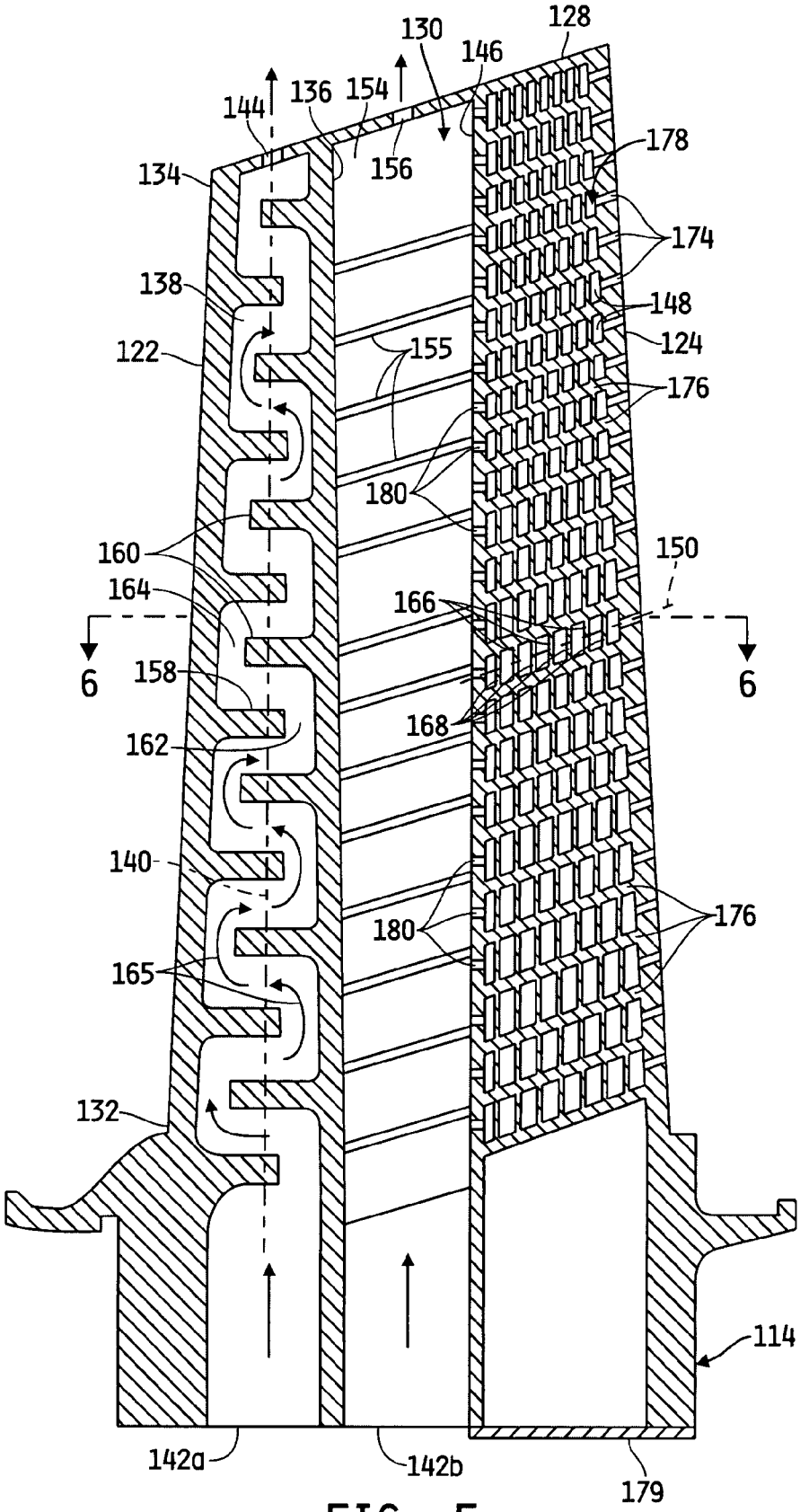
FIG. 5 is cross-sectional view of a second embodiment of the turbine blade.
Figure 6:
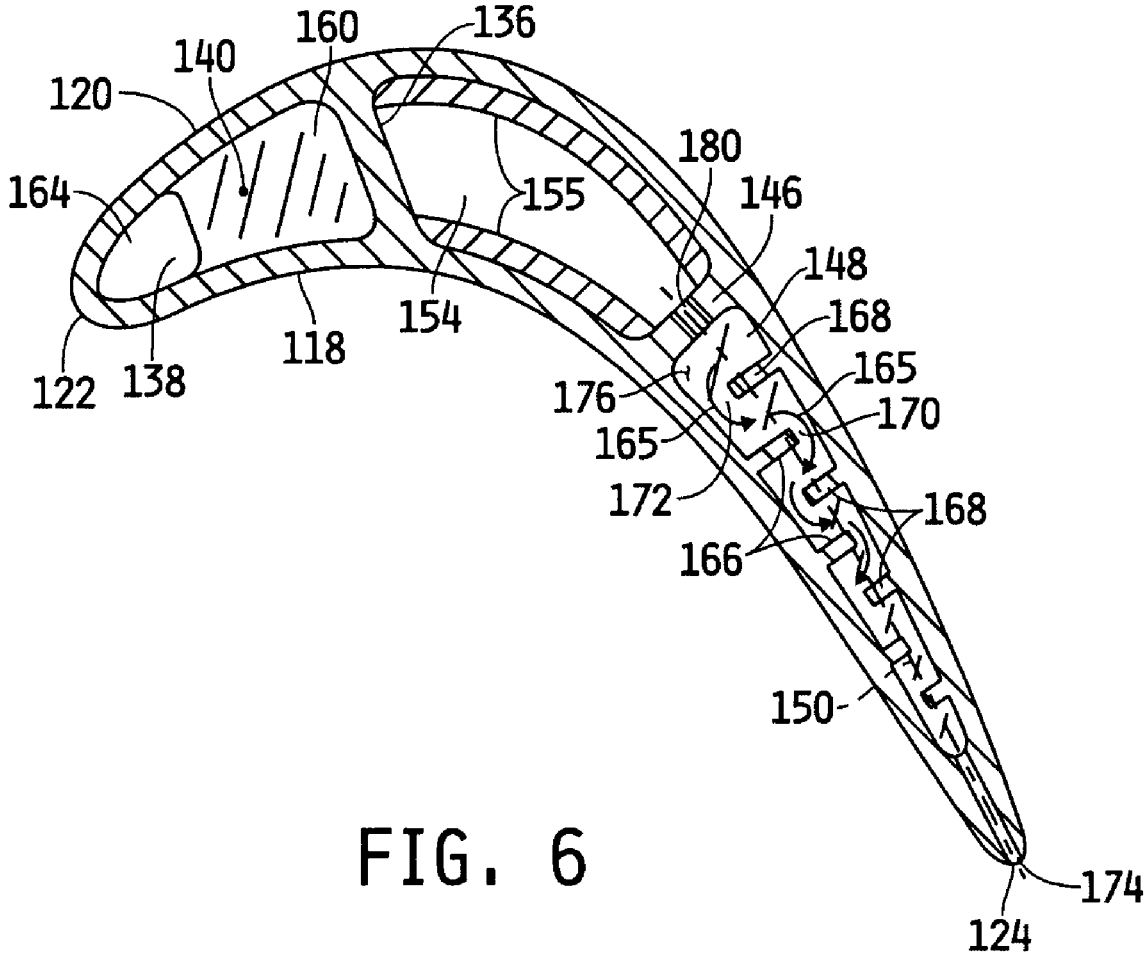
FIG. 6 is cross-sectional view of the turbine blade shown in FIG. 5 taken along line 6-6.

Referring to FIGS. 5-6, a second embodiment of the airfoil 12 is illustrated, and in which elements of the second embodiment corresponding to elements of the first described embodiment of FIGS. 2-4 are identified with the same reference numeral increased by 100.

As seen in FIG. 5, the airfoil 112 of the second embodiment includes a radially extending cooling cavity 130 located between a pressure side 118 and a suction side 120 and extending between inner and outer ends 132, 134 of the airfoil 112. First and second partitions 136, 146 extend radially through the cooling cavity 130 adjacent to leading and trailing edges 122, 124, respectively. The first partition 136 extends between the pressure and suction sides 118, 120 to define a leading edge flow channel 138. The leading edge flow channel 138 defines a first flow axis 140 located generally centrally between the pressure and suction sides 118, 120 and between the leading edge 122 and the first partition 136. Cooling fluid entering from a leading edge fluid entrance 142*a* within the root 114 flows generally along the first flow axis 140 to a leading edge fluid exit defined by an opening 144 at the blade tip 128.

The leading edge flow channel 138 includes a plurality of first rib members 158, 160 arranged in spaced relation along the first flow axis 140 in substantially the same manner as described for the embodiment of FIGS. 2-4. The leading edge flow channel 138 provides an undulating cooling fluid flow for providing cooling to the leading edge 122 in substantially the same manner as described for the embodiment of FIGS. 2-4.

The second partition 146 extends between the pressure side 118 and suction side 120 and a mid-chord flow channel 154 is located within the cooling cavity 130 between the first partition 136 and the second partition 146. Cooling fluid enters the mid-chord flow channel 154 through a fluid entrance 142*b* in the root 114 and may exit through a fluid exit defined by an opening 156 at the blade tip 128. The mid-chord flow channel 154 may further be provided with trip strips 155 along the interior surfaces of the pressure and suction sides 118, 120 to increase turbulence of the flow of cooling fluid along the interior surfaces.

A plurality of trailing edge cooling chamber partition walls 176 are located in radially spaced, generally parallel relation to each other within a trailing edge flow area 178 defined between the second partition 146 and the trailing edge 124 and between the pressure and suction sides 118, 120. The trailing edge flow area 178 comprises a plurality of trailing edge flow channels 148, where each trailing edge flow channel 148 extends in the chordal direction between pairs of adjacent trailing edge cooling chamber partition walls 176. A metering hole 180 is located through the second partition 146 at the radial location of each of the trailing edge flow channels 148 to define fluid entrances for cooling fluid to flow from the mid-chord flow channel 154 into each of the trailing edge flow channels 148. A plurality of trailing edge cooling holes 174 are provided extending from the trailing edge flow channels 148 through the trailing edge 124 to define fluid exits for each of the trailing edge flow channels 148.

It may be noted that the area of the root 114 below the trailing edge flow area 178 is closed by a cover plate 179. Accordingly, the cooling fluid supply for the trailing edge flow channels 148 is provided exclusively from the cooling fluid flow passing from the fluid entrance 142*b* and flowing through the mid-chord flow channel 154.

Each trailing edge flow channel 148 defines a second flow axis 150 (only one identified in the drawings) extending in the chordal direction and located generally centrally between the pressure and suction sides 118, 120 and between the pairs of adjacent partition walls 176. Cooling fluid entering through the metering holes 180 flows generally along the second flow axes 150 to the trailing edge fluid exits defined by the trailing edge cooling holes 174.

Each trailing edge flow channel 148 comprises a plurality of second rib members 166, 168 extending transversely to the second flow axis 150. The second rib members 166, 168 are spaced from each other in the chordal direction along the second flow axis 150, and extend transverse to the chordal and radial directions alternately from opposing sides of the trailing edge flow channels 148 (see FIG. 6). Specifically, the pressure side 118 forms a side from which the rib members 166 extend, and the suction side 120 forms an opposing side from which the rib members 168 extend. The second rib members 166, 168 each include a distal end that substantially extends past the second flow axis 150, and flow passages 170, 172 are defined adjacent the distal ends of the second rib members 166, 168, respectively, to permit passage of cooling fluid. Accordingly, the cooling fluid passing through the trailing edge flow channels 148 cannot flow in a straight or linear path as it flows along the second flow axis 150.

The cooling fluid passing through the trailing edge flow channels 148 follows a wavy or undulating flow path defined by essentially semi-circular flow sections 165, formed about the flow axis 150, as the fluid flows alternately around the second rib members 166, 168. The undulating flow paths in the trailing edge flow channels 148 create an impinging flow against the pressure and suction sides 118, 120 of the airfoil 12 to create a high internal heat transfer coefficient to increase the heat transfer in a manner similar to that described for the first embodiment.

As can be seen from the above described embodiments, the wavy or undulating flow path, defined by short alternately turning flow sections, provided in the leading and trailing edges of an airfoil facilitates internal cooling of the airfoil edges by providing an impinging airflow that increases the heat transfer occurring at the impingement surfaces. The present concept is particularly beneficial in airfoil designs in which a low cooling fluid flow is provided for cooling turbine blades. Further, fluid flow within the flow channels may be controlled or modified to adjust for a particular external heat load on the airfoil by adjusting the spacing between the rib members and/or by adjusting the size of the fluid passages adjacent the distal ends of the rib members to adjust the rate and vary the changes in momentum of the cooling fluid as it passes through the airfoil.

It may be noted that although the rib members illustrated within the flow channels are shown as essentially comprising a rectangular cross-section, other cross-sectional configurations may be provided to facilitate the directional changes of the cooling fluid as it flows through each flow channel. For example, curved or semi-circular surfaces may be provided at the base of the rib members, adjacent the connections to the opposite sides of the flow channel, to provide a smooth directional change where the flow impinges on the opposite sides.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An airfoil for a turbine of a gas turbine engine comprising:

an outer wall extending radially between opposing inner and outer ends of said airfoil, said outer wall comprising a pressure side and a suction side joined together at chordally spaced apart leading and trailing edges of said airfoil;

a radially extending cooling cavity located between said inner and outer ends of said airfoil and between said pressure side and said suction side;

at least one partition extending radially through said cooling cavity and extending from said pressure side to said suction side, said at least one partition defining at least one flow channel within said cooling cavity adjacent at least one of said leading edge and said trailing edge, said at least one flow channel defining a flow axis extending between said pressure side and said suction side from a fluid entrance to a fluid exit at an opposite end of said at least one flow channel; and a plurality of rib members extending transversely to said flow axis into said at least one flow channel, said rib members spaced from each other along said flow axis and extending alternately from opposing sides of said at least one flow channel to direct flow of cooling fluid in an undulating path alternately impinging on said opposing sides of said at least one flow channel, wherein said opposing sides comprise said pressure side and said suction side and said flow axis extends in said chordal direction, and wherein said rib members each include a distal end that substantially extends past said flow axis such that said cooling fluid cannot flow in a straight path through said at least one flow channel along said flow axis.

2. The airfoil of claim 1, wherein said at least one flow channel is further defined by radially spaced trailing edge cooling channel partition walls extending between said at least one partition and said trailing edge and extending from said pressure side to said suction side.

3. The airfoil of claim 2, including a plurality of said radially spaced trailing edge cooling channel partition walls defining a plurality flow channels extending in the chordal direction from said at least one partition to said trailing edge.

4. The airfoil of claim 3, including a plurality of metering holes through said partition defining a fluid entrance for cooling fluid to flow from a mid-chord flow channel defined on one side of said partition into each of said flow channels on an opposite side of said partition, and each said flow channel including at least one trailing edge cooling hole defining said cooling fluid exit.

5. An airfoil for a turbine blade of a gas turbine engine comprising:

an outer wall extending radially between opposing inner and outer ends of said airfoil, said outer wall comprising a pressure side and a suction side joined together at chordally spaced apart leading and trailing edges of said airfoil;

a radially extending cooling cavity located between said inner and outer ends of said airfoil and between said pressure side and said suction side;

a first partition extending radially through said cooling cavity adjacent said leading edge and extending from said pressure side to said suction side to define a leading edge flow channel, said leading edge flow channel defining a first flow axis extending between said pressure side and said suction side from a fluid entrance to a fluid exit at an opposite end of said leading edge flow channel;

a plurality of first rib members extending transversely to said first flow axis into said leading edge flow channel, said rib first members spaced from each other along said first flow axis and extending alternately from opposing sides of said leading edge flow channel to direct flow of cooling fluid in an undulating path alternately impinging on said opposing sides of said leading edge flow channel;

a second partition extending radially through said cooling cavity adjacent said trailing edge and extending from said pressure side to said suction side to define at least one trailing edge flow channel, said at least one trailing edge flow channel defining at lease least one second flow axis extending between said pressure side and said suction side from a fluid entrance to a fluid exit at an opposite end of said at least one trailing edge flow channel; and a plurality of second rib members extending transversely to said at least one second flow axis into said at least one trailing edge flow channel, said second rib members spaced from each other along said at least one second flow axis and extending alternately from opposing sides of said at least one trailing edge flow channel to direct flow of cooling fluid in an undulating path alternately impinging on said opposing sides of said at least one trailing edge flow channel.

6. The airfoil of claim 5, wherein said first flow axis extends radially through said airfoil, and said first rib members extend in a chordal direction from said leading edge and said first partition.

7. The airfoil of claim 6, wherein said second flow axis extends radially through said airfoil, and said second rib members extend in a chordal direction from said trailing edge and said second partition.

8. The airfoil of claim 7, wherein said fluid entrances for said leading edge and trailing edge flow channels are located at said inner end of airfoil and said fluid exits for said leading edge and trailing edge flow channels are located at said outer end of airfoil.

9. The airfoil of claim 8, including a plurality of trailing edge cooling holes extending from said trailing edge flow channel through said trailing edge.

10. The airfoil of claim 6, wherein said at least one second flow axis extends in a chordal direction, and said second rib members extend inwardly to said at least one second flow axis from said pressure side and said suction side.

11. The airfoil of claim 10, including a plurality of radially spaced trailing edge cooling channel partition walls extending from said second partition to said trailing edge to define a plurality of trailing edge flow channels extending in a chordal direction, each said trailing edge flow channel comprising said second rib members extending alternately from said pressure side and said suction side.

12. The airfoil of claim 11, including a plurality of metering holes through said second partition defining a fluid entrance for cooling fluid to flow from a mid-chord flow channel defined between said first partition and said second partition into each of said trailing edge flow channels, and each said trailing edge flow channel including at least one trailing edge cooling hole defining said cooling fluid exit.

13. An airfoil for a turbine of a gas turbine engine comprising:

an outer wall extending radially between opposing inner and outer ends of said airfoil, said outer wall comprising a pressure side and a suction side joined together at chordally spaced apart leading and trailing edges of said airfoil;

a radially extending cooling cavity located between said inner and outer ends of said airfoil and between said pressure side and said suction side;

at least one partition extending radially through said cooling cavity and extending from said pressure side to said suction side, said at least one partition defining at least one flow channel within said cooling cavity adjacent at least one of said leading edge and said trailing edge, said at least one flow channel defining a flow axis extending between said pressure side and said suction side from a fluid entrance to a fluid exit at an opposite end of said at least one flow channel; and a plurality of rib members oriented generally perpendicular to said flow axis so as to extend into said at least one flow channel, said rib members spaced from each other along said flow axis and extending alternately from opposing sides of said at least one flow channel to direct flow of cooling fluid in an undulating path alternately impinging on said opposing sides of said at least one flow channel, wherein said rib members each include a distal end that substantially extends past said flow axis such that said cooling fluid cannot flow in a straight path through said at least one flow channel along said flow axis.

14. The airfoil of claim 13, wherein:

said at least one partition comprises a first partition and a second partition:

said first partition extending radially through said cooling cavity adjacent said leading edge and extending from said pressure side to said suction side to define a leading edge flow channel, said leading edge flow channel defining a first flow axis extending between said pressure side and said suction side from a fluid entrance to a fluid exit at an opposite end of said leading edge flow channel; and said second partition extending radially through said cooling cavity adjacent said trailing edge and extending from said pressure side to said suction side to define at least one trailing edge flow channel, said at least one trailing edge flow channel defining at least one second flow axis extending between said pressure side and said suction side from a fluid entrance to a fluid exit at an opposite end of said at least one trailing edge flow channel; and said plurality of rib members comprises a plurality of first rib members and a plurality of second rib members;

said plurality of first rib members oriented generally perpendicular to said first flow axis so as to extend into said leading edge flow channel, said rib first members spaced from each other along said first flow axis and extending alternately from opposing sides of said leading edge flow channel to direct flow of cooling fluid in an undulating path alternately impinging on said opposing sides of said leading edge flow channel; and said plurality of second rib members oriented generally perpendicular to said at least one second flow axis so as to extend into said at least one trailing edge flow channel, said second rib members spaced from each other along said at least one second flow axis and extending alternately from opposing sides of said at least one trailing edge flow channel to direct flow of cooling fluid in an undulating path alternately impinging on said opposing sides of said at least one trailing edge flow channel.

15. The airfoil of claim 14, said fluid entrance for said at least one flow channel is located at said inner end of said airfoil and said fluid exit is located at said outer end of said airfoil, said flow axis extending in a spanwise direction and said rib members extending in a chordal direction.

16. The airfoil of claim 15, wherein said at least one partition defines one of said opposing sides of said flow channel.

17. The airfoil of claim 16, wherein said leading edge defines the other of said opposing sides of said at least one flow channel.

18. The airfoil of claim 16, wherein said trailing edge defines the other of said opposing sides of said at least one flow channel.

19. The airfoil of claim 18, including a plurality of trailing edge cooling holes extending from said flow channel through said trailing edge.

20. The airfoil of claim 13, wherein said at least one flow channel comprises a flow channel located adjacent each of said leading edge and said trailing edge.

* * * * *